US009639054B2

(12) United States Patent
Mori et al.

(10) Patent No.: US 9,639,054 B2
(45) Date of Patent: May 2, 2017

(54) IMAGE FORMING DEVICE FACILITATING REMOVAL OF JAMMED SHEET

(71) Applicants: Hiroki Mori, Nagoya (JP); Atsushi Miwa, Anjo (JP)

(72) Inventors: Hiroki Mori, Nagoya (JP); Atsushi Miwa, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/834,598

(22) Filed: Mar. 15, 2013

(65) Prior Publication Data

US 2013/0259519 A1 Oct. 3, 2013

(30) Foreign Application Priority Data

Mar. 30, 2012 (JP) ..... 2012-081562

(51) Int. Cl.
*G03G 15/00* (2006.01)
*G03G 21/18* (2006.01)
*G03G 21/16* (2006.01)

(52) U.S. Cl.
CPC ..... *G03G 21/1842* (2013.01); *G03G 21/1638* (2013.01); *G03G 21/1853* (2013.01); *G03G 2221/1884* (2013.01)

(58) Field of Classification Search
CPC ..... G03G 21/1842
See application file for complete search history.

(56) References Cited

U.S. PATENT DOCUMENTS 5,581,338 A * 12/1996 Nakamichi et al. ..... 399/310
5,634,178 A * 5/1997 Sugiura et al. ..... 399/110
5,907,751 A 5/1999 Kawaguchi et al.
5,983,054 A 11/1999 Kameyama
6,101,350 A * 8/2000 Suzuki et al. ..... 399/113
(Continued)

FOREIGN PATENT DOCUMENTS

EP 2400347 A2 12/2011
JP H05-14657 A 1/1993
(Continued)

OTHER PUBLICATIONS

Co-pending U.S. Appl. No. 13/834,104, filed Mar. 15, 2013.
(Continued)

*Primary Examiner* — Billy Lactaoen
*Assistant Examiner* — Arlene Heredia Ocasio
(74) *Attorney, Agent, or Firm* — Banner & Witcoff, Ltd.

(57) ABSTRACT

An image forming device includes a main casing, a process cartridge, a sheet passage, and a first guide. The process cartridge includes a photosensitive body, and a transfer member, and is configured to be attachable to and detachable from the main casing. The sheet passage extends in a first direction and is configured to allow a sheet to pass between the photosensitive body and the transfer member. The first guide is configured to guide the process cartridge such that the process cartridge is attachable to and detachable from the main casing. The first guide has a support portion extending in a second direction substantially perpendicular to the first direction and configured to support the process cartridge in a state where the process cartridge is attached to the main casing.

13 Claims, 7 Drawing Sheets

(56) References Cited

U.S. PATENT DOCUMENTS

| | | | | |
|---|---|---|---|---|
| 6,229,974 | B1 | 5/2001 | Noda | |
| 7,174,117 | B2 | 2/2007 | Okabe | |
| 7,764,903 | B2 * | 7/2010 | Ishikawa et al. | 399/111 |
| 8,606,141 | B2 | 12/2013 | Furuya et al. | |
| 2002/0131790 | A1 * | 9/2002 | Sato et al. | 399/111 |
| 2005/0025521 | A1 * | 2/2005 | Mori et al. | 399/111 |
| 2006/0158686 | A1 * | 7/2006 | Watanabe | 358/1.15 |
| 2007/0166070 | A1 | 7/2007 | Sato | |
| 2008/0145095 | A1 * | 6/2008 | Hoshi et al. | 399/111 |
| 2008/0152386 | A1 * | 6/2008 | Sakaguchi et al. | 399/114 |
| 2008/0247793 | A1 * | 10/2008 | Sato et al. | 399/388 |
| 2011/0158682 | A1 * | 6/2011 | Takagi et al. | 399/111 |
| 2011/0170905 | A1 | 7/2011 | Furuya et al. | |
| 2011/0243601 | A1 * | 10/2011 | Furuya et al. | 399/111 |
| 2011/0311269 | A1 * | 12/2011 | Murooka | 399/110 |

FOREIGN PATENT DOCUMENTS

| | | | |
|---|---|---|---|
| JP | H06-133092 | A | 5/1994 |
| JP | H06-314001 | A | 11/1994 |
| JP | H08-305251 | A | 11/1996 |
| JP | 2000-250310 | A | 9/2000 |
| JP | 2007-163879 | A | 6/2007 |
| JP | 2007-163880 | A | 6/2007 |
| JP | 2008-224782 | A | 9/2008 |
| JP | 2009-086034 | A | 4/2009 |
| JP | 4474178 | B2 | 6/2010 |
| JP | 2010-156750 | A | 7/2010 |
| JP | 2011-008286 | A | 1/2011 |
| JP | 4667444 | B2 | 4/2011 |
| JP | 4701313 | B2 | 6/2011 |
| JP | 4721464 | B2 | 7/2011 |
| JP | 2011-164587 | A | 8/2011 |
| JP | 2011-227457 | A | 11/2011 |

OTHER PUBLICATIONS

Co-pending U.S. Appl. No. 13/834,874, filed Mar. 15, 2013.

Non-Final Office Action received in corresponding U.S. Appl. No. 13/834,104 mailed Jun. 27, 2014.

Aug. 13, 2014—(US) Notice of Allowance—U.S. Appl. No. 13/834,874.

Oct. 29, 2014—(US) Notice of Allowance—U.S. Appl. No. 13/834,104.

Feb. 2, 2015—(CN) Notification of First Office Action—App 201310091197.X.

Mar. 20, 2015—(CN) Notification of the First Office Action—App 201310091198.4.

Mar. 3, 2015—(CN) First Office Action—App 201310091199.9.

Sep. 15, 2015—(CN) Notification of the Second Office Action—App 201310091197.X.

Nov. 3, 2015—(CN) Notification of the Second Office Action—App 201310091199.9.

Nov. 26, 2015—(CN) Notification of Second Office Action —App 201310091198.4.

Dec. 1, 2015—(JP) Office Action—App 2012-081539.

Jan. 19, 2016—(JP) Office Action—App 2012-081562.

Jun. 2, 2016—(CN) Decision of Rejection—App 201310091198.4.

Apr. 14, 2016—(CN) Notification of the Third Office Action—App 201310091199.9.

Jan. 18, 2017—(EP) Extended Search Report—App 13159596.9.

* cited by examiner

IMAGE FORMING DEVICE FACILITATING REMOVAL OF JAMMED SHEET

CROSS REFERENCE TO RELATED APPLICATION

This application claims priority from Japanese Patent Application No. 2012-081562 filed Mar. 30, 2012. The entire content of the priority application is incorporated herein by reference.

TECHNICAL FIELD

The present invention relates to an image forming device provided with a process cartridge having a photosensitive body and a transfer member.

BACKGROUND

Japanese Laid-Open Patent Publication No. 2000-250310 discloses an image forming device including a process cartridge. The process cartridge includes a photosensitive body and a transfer member, and is configured to be attachable to and detachable from a main casing. Specifically, the process cartridge is configured to move at an acute angle with respect to a sheet passage of a sheet which passes between the photosensitive body and the transfer member.

SUMMARY

When a sheet jamming occurs between the photosensitive body and the transfer member during the printing operation, the jammed sheet is removed from the main casing by detaching the process cartridge therefrom.

However, the present inventor has found that according to the conventional image forming device the jammed sheet still remains in the main casing during detachment of the process cartridge. This is because the sheet which has been nipped between the photosensitive body and the transfer member may be released therefrom at the above described acute angle relative to the sheet passage. When the sheet remains in the main casing, the user needs to reach inside the main casing with his/her hand to remove the sheet after detaching the process cartridge. Such sheet removing operation would be cumbersome.

Thus, it is an object of the present invention to provide an image forming device facilitating removal of the jammed sheet.

This and other object of the present invention will be attained by an image forming device for forming an image on a sheet including: a main casing, a process cartridge, a sheet passage and a first guide. The process cartridge includes a photosensitive body, and a transfer member facing the photosensitive body, and is configured to be attachable to and detachable from the main casing. The sheet passage extends in a first direction and is configured to allow the sheet to pass between the photosensitive body and the transfer member. The first guide is configured to guide the process cartridge such that the process cartridge is attachable to and detachable from the main casing. The first guide has a support portion extending in a second direction substantially perpendicular to the first direction and is configured to support the process cartridge in a state where the process cartridge is attached to the main casing.

DETAILED DESCRIPTION

An image forming device according to one embodiment of the present invention will now be discussed in more detail with reference to the drawings. A laser printer will be illustrated as a typical example of the image forming device.

Figure 1:
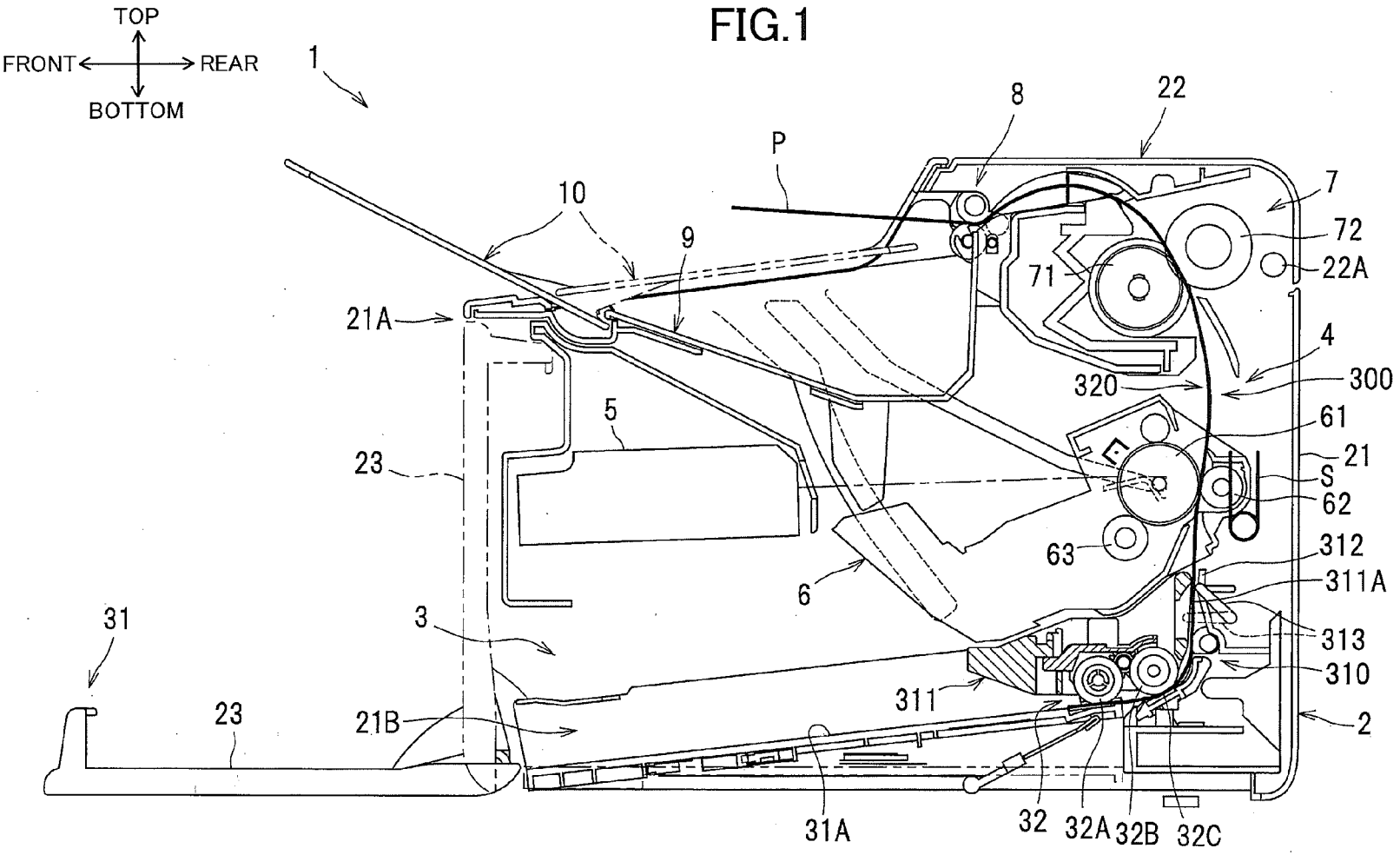
FIG. 1 is a schematic view of a laser printer according to one embodiment of the present invention.

Throughout the description, the terms "front", "rear", "left" and "right" will be used assuming that the laser printer is disposed in an orientation in which it is intended to be used. In FIG. 1, a front side and a rear side of the printer are a left side and a right side of the sheet, respectively.

[General Structure of Laser Printer]

As shown in FIG. 1, the laser printer 1 includes a main body 2, a feeder unit 3 for feeding a sheet P, and an image forming unit 4 for forming an image on the sheet P.

The main body 2 includes a main casing 21, a top cover 22 and a front cover 23. The main casing 21 has an upper portion formed with an opening 21A (FIG. 2), which is open upward, through which the process cartridge 6 is attached to and detached from the main casing, and has a front portion formed with a front opening 21B for supplying the sheet P into the main body 2.

The top cover 22 has a rear end portion provided with a pivot shaft 22A, so that the top cover 22 is supported by the main casing 21 and is pivotally movable about an axis of the pivot shaft 22A. Thus, the opening 21A is opened or closed by pivotal movement of the top cover 22 in upward and downward directions.

The top cover 22 has a top surface functioning as a discharge tray 9 for accommodating the sheet P discharged from the main casing 21 by a discharge roller 8 described later. An extension cover 10 is supported by the top cover 22. The extension cover 10 has a front end portion provided with a pivot shaft (not shown), and the extension cover 10 is pivotally movable about an axis of the pivot shaft between a first position as shown by a two-dotted chain line and a second position as shown by a solid line. In the first position the extension cover 10 covers the top surface of the discharge tray 9, and in the second position the extension cover is positioned adjacent to the discharge tray 9 for supporting a leading end portion of the sheet P.

The front cover 23 is configured to cover a front portion of the main body 2, and is supported by the main casing 21. That is, the front cover 23 has a lower end portion pivotally movably connected to the main casing 21. Thus, the front cover 23 opens or closes the front opening 21B of the main casing 21 by the pivotal movement of the front cover 23 in frontward and rearward directions.

The feeder unit 3 is positioned at a lower portion of the main body 2, and includes a sheet supply tray 31 for accommodating the sheet P and a sheet supplying mechanism 32 for supplying the sheet P toward the image forming unit 4.

The sheet supply tray 31 is constituted by a sheet mounting plate 31A positioned at the lower portion of the main body 2, and the front cover 23 described above. The front cover 23 constitutes a part of the sheet supply tray 31 in a state where the front cover 23 is pivotally moved frontward. The sheet mounting plate 31A is configured to lift the sheet P toward a sheet supply roller 32A each time when a sheet P is delivered to the image forming unit 4.

The sheet supplying mechanism 32 includes the sheet supply roller 32A, a separation roller 32B as a first conveyer roller, and a separation pad 32C. The sheet supply roller 32A is positioned upstream of the separation roller 32B in a sheet feeding direction and on a rear end of the sheet mounting plate 31A. The separation roller 32B is disposed in opposition to the separation pad 32C.

In the feeder unit 3, the sheet P is placed on the supply sheet tray 31 after the front cover 23 is pivotally moved frontward to provide the sheet supply tray 31. Then, the sheet P on the supply sheet tray 31 is conveyed to the separation roller 32B upon rotation of the sheet supply roller 32A in contact with the sheet P. The conveyed sheet P is then separated from a remaining sheet stack on the sheet supply tray 31 when the sheet P is moved past the separation roller 32B and the separation pad 32C. The separated sheet is then conveyed to the image the image forming unit 4.

The image forming unit 4 includes a scanner unit 5, the process cartridge 6 and a fixing unit 7.

The scanner unit 5 is positioned at a front side of the main body 2, and above the feeder unit 3. The scanner unit 5 includes a laser emission portion, a polygon mirror, lenses and reflection mirrors (not shown). The scanner unit 5 is configured to emit a laser beam at high speed scan on a surface of a photosensitive drum 61 described later as a photosensitive body.

The process cartridge 6 is positioned at a rear side of the main body 2 and above the feeder unit 3. The process cartridge 6 is attachable to and detachable from the main casing 21 through the opening 21A. The process cartridge 6 includes the photosensitive drum 61, a transfer roller 62 disposed in opposition thereto, a charger (not shown), a developing roller 63, and a toner container (not shown).

In the process cartridge 6, after a surface of the rotating photosensitive drum 61 has been uniformly charged by the charger, the surface is exposed to laser beam at high speed scan based on image data. Thus, a potential of the exposed surface is lowered to provide an electrostatic latent image based on the image data.

Then toner accommodated in the toner container is supplied by the developing roller 63 to the electrostatic latent image region on the photosensitive drum 61, thereby forming a toner image on the surface of the photosensitive drum 61. When the sheet P is conveyed between the photosensitive drum 61 and the transfer roller 62, the toner image formed on the photosensitive drum 61 is transferred onto the sheet P. Details of the process cartridge 6 will be described later.

The fixing unit 7 is positioned at the rear side of the main body 2 and above the process cartridge 6. The fixing unit 7 includes a heat roller 71 and a pressure roller 72 as a second conveyer roller.

The heat roller 71 is configured to heat the sheet P, and contains a halogen lamp as a heat source. The pressure roller 72 is configured to nip and convey the sheet P in cooperation with the heat roller 71, and is positioned diagonally above and frontward of the heat roller 71.

In the fixing unit 7, the toner image transferred onto the sheet P is thermally fixed during passage transit of the sheet P between the heat roller 71 and the pressure roller 72. The sheet P carrying the fixed toner image is then conveyed by the discharge roller 8 disposed downstream of the fixing unit 7 for discharging the sheet onto the discharge tray 9.

[Sheet Passage and Ambient Structure Around the Process Cartridge]

A sheet passage 300 and an ambient structure around the process cartridge 6 according to one embodiment of the present invention will next be described.

As shown in FIG. 1, the sheet passage 300 is a U-shaped passage extending from the sheet supply tray 31 to the discharge tray 9 through the image forming unit 4. The sheet passage 300 is constituted by a first sheet feed passage 310 and a second sheet feed passage 320. The first sheet passage 310 extends from the sheet supply tray 31 and is positioned upstream of the photosensitive drum 61 and the transfer roller 62 in a sheet conveying direction. The second sheet passage 320 is positioned downstream of the photosensitive drum 61 and the transfer roller 62 in the sheet conveying direction, and reaches the discharge tray 9.

The first sheet passage 310 extends rearward from the sheet supply tray 31 through the sheet supplying mechanism 32, and then upward to a position between the photosensitive drum 61 and the transfer roller 62. The first sheet passage 310 has a downstream portion of the sheet supplying mechanism 32. The downstream portion is constituted by a roller support member 311 and a guide chute 312 positioned rearward of the roller support member 311.

The roller support member 311 rotatably supports the sheet supply roller 32A and the separation roller 32B, and is positioned between the process cartridge 6 and the sheet supply tray 31. The roller support member 311 has a rear surface 311A configured to guide the sheet P conveyed by the sheet supplying mechanism 32.

The guide chute 312 has a front surface configured to guide the sheet P conveyed by the sheet supplying mechanism 32.

A sheet sensor 313 is provided in the first sheet passage 310. The sheet sensor 313 is used for detecting the sheet P which is supplied by the feeder unit 3 and runs through the first sheet passage 310. The sheet sensor 313 is positioned in confrontation with the rear surface 311A of the roller support member 311, and is configured to protrude frontward and horizontally. The roller support member 311 constitutes a part of the first sheet passage 310, and is positioned between the process cartridge 6 and the sheet sensor 313.

The sheet sensor 313 is configured to be pivotally movably supported by the guide chute 312 and urged in an upstream direction (downward in FIG. 1) by a spring (not shown). The sheet sensor 313 has its default posture (as shown by a dotted line in FIG. 1) where the sheet P does not run through the first sheet passage 310. In the default posture, an upstream surface of the sheet sensor 313 is in contact with a stop member (not shown) positioned at the guide chute 312. The sheet sensor 313 pivotally moves in a downstream direction (upward in FIG. 1) from the default posture, only when the sheet P passes through the first sheet passage 310.

The second sheet passage 320 extends from the position between the photosensitive drum 61 and the transfer roller 62, and then bent frontward though the fixing unit 7.

Each path length of the first sheet passage 310 and the second sheet passage 320 is adjusted such that a path length between the separation roller 32B and a sheet nip position between the heat roller 71 and the pressure roller 72, is shorter than a sheet length in the sheet conveying direction.

Figure 3:
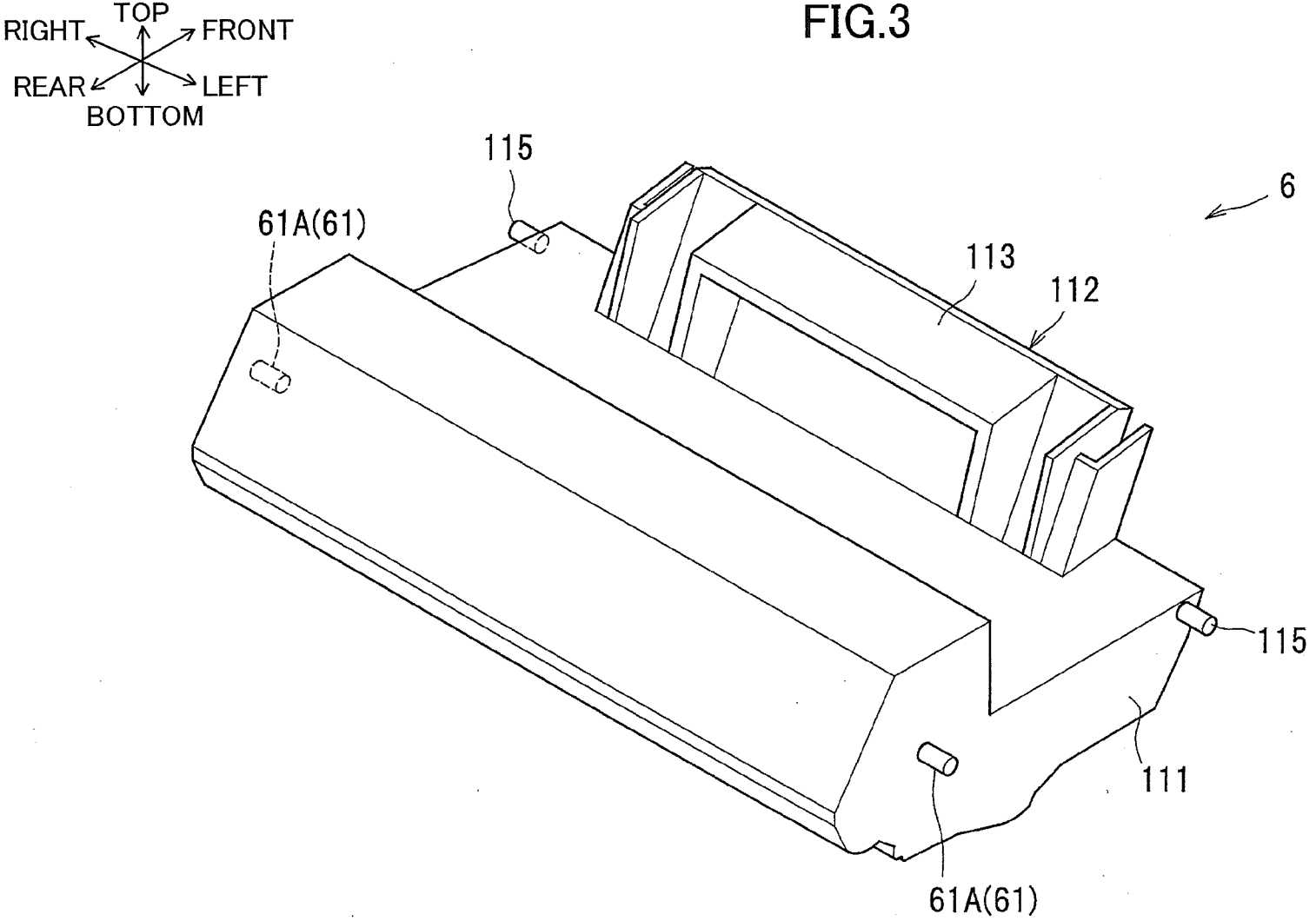
FIG. 3 is a perspective view of the process cartridge.

The process cartridge 6 has a rear end portion rotatably supporting the photosensitive drum 61 and the transfer roller 62 (FIG. 1). The process cartridge 6 has left and right walls 111. As shown in FIG. 3, the shaft 61A extends through the left and right walls 111 and protrudes outward therefrom. The transfer roller 62 has end portions each being exposed to an outside. Each exposed end portion is urged toward the photosensitive drum 61 by a spring S functioning as an urging member provided in the main body 2 in a state where the process cartridge 6 is attached to the main casing 21 as shown in FIG. 1.

As shown in FIG. 3, the process cartridge 6 has a front wall 112 provided with a hand grip portion 113 configured to be gripped by a user for attachment and detachment of the process cartridge 6. A boss 115 is provided at the left and right walls 111.

The boss 115 protrudes laterally outward from the left and right walls 111, and is positioned at the front end portion thereof.

The photosensitive drum 61 and the transfer roller 62 are aligned side by side in frontward/rearward direction. The process cartridge 6 has a posture such that the front end portion is positioned lower than the rear end portion in a state when the attachment of the process cartridge 6 to the main casing 21 is completed.

A guide 200 is formed in the main casing 21 for guiding the movement of the process cartridge 6. More specifically, the shaft 61A and the boss 115 are guided by the guide 200 for attaching or detaching the process cartridge 6 to and from the main casing 21. The guide 200 is configured to guide the process cartridge 6 therealong, so that the process cartridge 6 is configured to move in a direction substantially perpendicular to the sheet feed passage 300 when the process cartridge 6 is initially moved in a detaching direction from a fully attached position.

Figure 2:
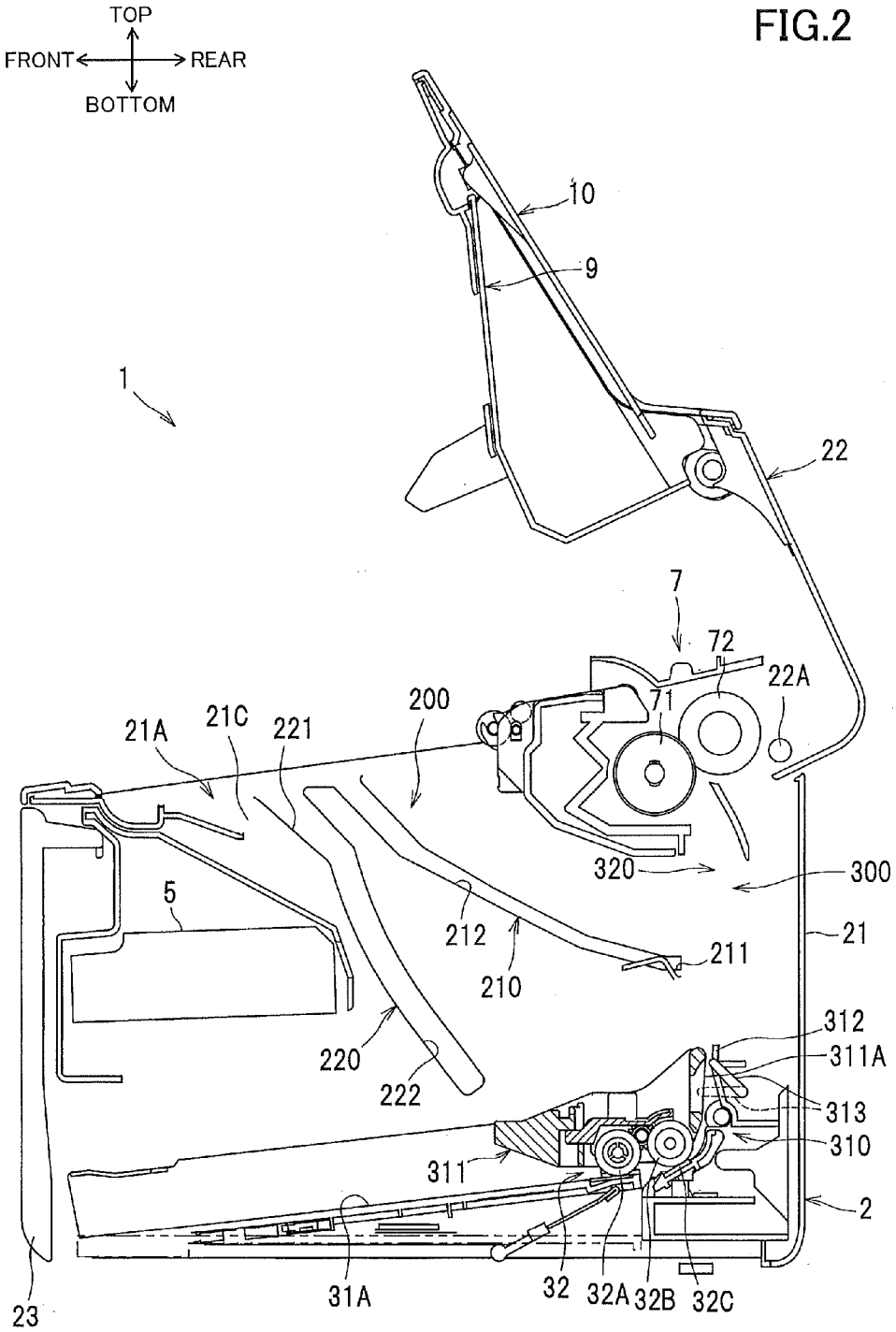
FIG. 2 is a view showing a state where a process cartridge has been detached after opening a top cover of the laser printer according to the embodiment.

As shown in FIG. 2, the guide 200 includes a first guide 210 and a second guide 220. The first guide 210 is configured to guide the shaft 61A of the photosensitive drum 61, and the second guide 220 is configured to guide the boss 115. Therefore the guide 200 is configured to guide the process cartridge 6 such that the process cartridge 6 is attachable to or detachable from the main casing 21 while changing the posture of the process cartridge 6 in the main casing 21.

The first guide 210 has a support portion 211 configured to support the shaft 61A of the photosensitive drum 61. The second guide 220 has a lower end portion configured to support the boss 115, thereby providing the fully attached position of the process cartridge 6. The support portion 211 and the lower end portion of the second guide 220 define fixed positions of the shaft 61A and the boss 115, respectively.

The first guide 210 includes a guide portion 212 in the form of a groove formed on an inner surface of a side panel 21C to be positioned adjacent to each of the left and right walls 111 of the process cartridge 6. The first guide 210 also includes the support portion 211.

The support portion 211 is configured to support the shaft 61A positioned at the fixed position when the process cartridge 6 is fully attached to the main casing 21. The support portion 211 has a generally horizontal surface extending in a direction substantially perpendicular to the sheet feed passage 300 extending in a vertical direction.

The support portion 211 is positioned at an upstream end portion of the guide portion 212 in a detaching direction of the process cartridge 6. The guide portion 212 extends frontward and diagonally upward toward the opening 21A from the support portion 211 to the upper end portion of the side panel 21C.

The second guide 220 is in the form of a groove formed on the inner surface of each side panel 21C of the main casing 21, and is positioned frontward of the first guide 210. The second guide 220 has an upper end portion open to the upper end portion of the side panel 21C, and a lower end portion defining the fixed position of the boss 115.

The second guide 220 has an upper portion 221 having a substantially linear line shape and extending side by side along the first guide 210 from the upper end portion of the side panel 21C. The second guide 220 has a lower portion 222 gently extending from a lower end of the upper portion 221 to the fixed position of the boss 115. The lower portion 222 is curved away from the first guide 210.

Figure 4:
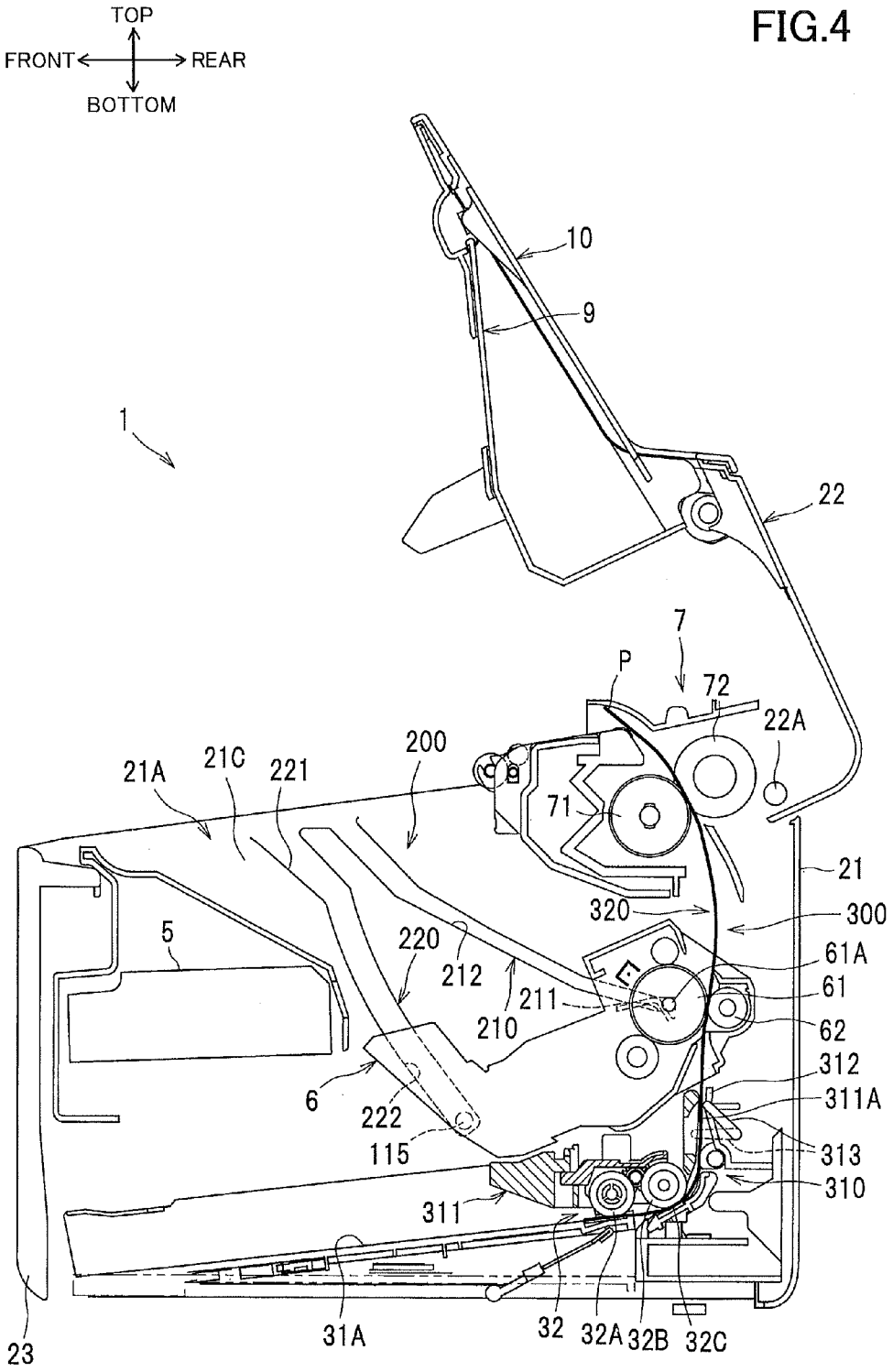
FIG. 4 is a view showing a state where the top cover is opened for removing a jammed sheet in the printer according to the embodiment.

The following advantages can be obtained in the above-described embodiment: As shown in FIG. 4, when sheet jamming occurs in the state where the jammed sheet P is nipped between the photosensitive drum 61 and the transfer roller 62, the user opens the top cover 22 and grips the hand grip portion 113 to pull the process cartridge 6 near side for detaching from the main casing 21.

At this time, the transfer roller 62 is urged toward the photosensitive drum 61 positioned frontward thereof by the spring S provided in the main body 2 in the state where the process cartridge 6 is attached to the main casing 21. In other words, the transfer roller 62 is urged toward the photosensitive drum 61 in the direction substantially parallel with the extending direction of the support portion 211. Thus, the user can take out the process cartridge 6 with a small pulling force by making use of urging force.

Figure 5:
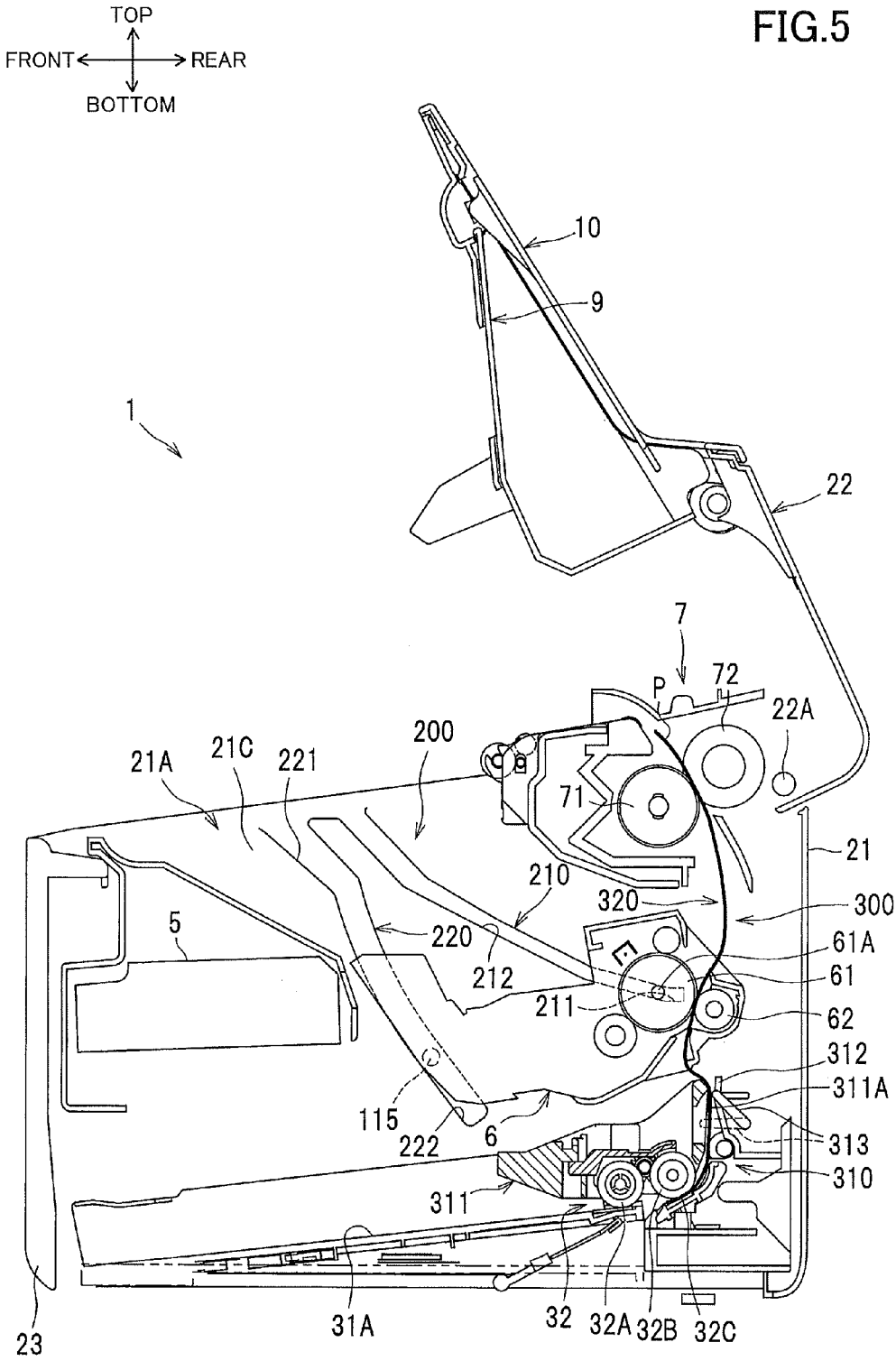
FIG. 5 is a view for description of frontward movement of the process cartridge attached to a main casing along the support portion in the printer according to the embodiment.

When the user pulls the process cartridge 6 from the fully attached position thereof toward the opening 21A, the boss 115 and the shaft 61A are guided by the lower portion 222 of the second guide 220 and the support portion 211 of the first guide 210, and are moved diagonally upward and forward, respectively as shown in FIG. 5.

Since the support portion 211 extends in the direction substantially perpendicular to the sheet feed passage 300, the jammed sheet P can be taken out along with the process cartridge 6 while maintaining nipped state of the sheet between the photosensitive drum 61 and the transfer roller 62 of the process cartridge 6. Such jammed sheet removing operation described above is easier than other sheet removing operation where the jammed sheet P remains in the main casing 21 after sheet drop out from the nip between the photosensitive drum 61 and the transfer roller 62.

The path length between the separation roller 32B and the sheet nip position between the heat roller 71 and the pressure roller 72, is shorter than the sheet length in the sheet conveying direction. Thus, the jammed sheet P can be pulled by the process cartridge 6 in a well-balanced manner in the state where the jammed sheet P is nipped at the separation roller 32B, the photosensitive drum 61 and the transfer roller 62, and the heat roller 71 and the pressure roller 72.

The roller support 311 is positioned between the process cartridge 6 and the sheet sensor 313. Thus, when the jammed sheet P is pulled by the process cartridge 6, the jammed sheet P can be taken away from the sheet feed passage 300 without mechanical interference of the pulled sheet P with the sheet sensor 313. More specifically, in the present embodiment, the jammed sheet P pulled together with the process cartridge 6 is guided along the rear surface 311A of the roller support 311 in the sheet conveying direction which is coincident with the downstream direction of the sheet sensor 313 (upward in FIG. 1). Thus, damage to the jammed sheet P due to the mechanical interference with the sheet sensor 313 can be avoided.

Figure 6:
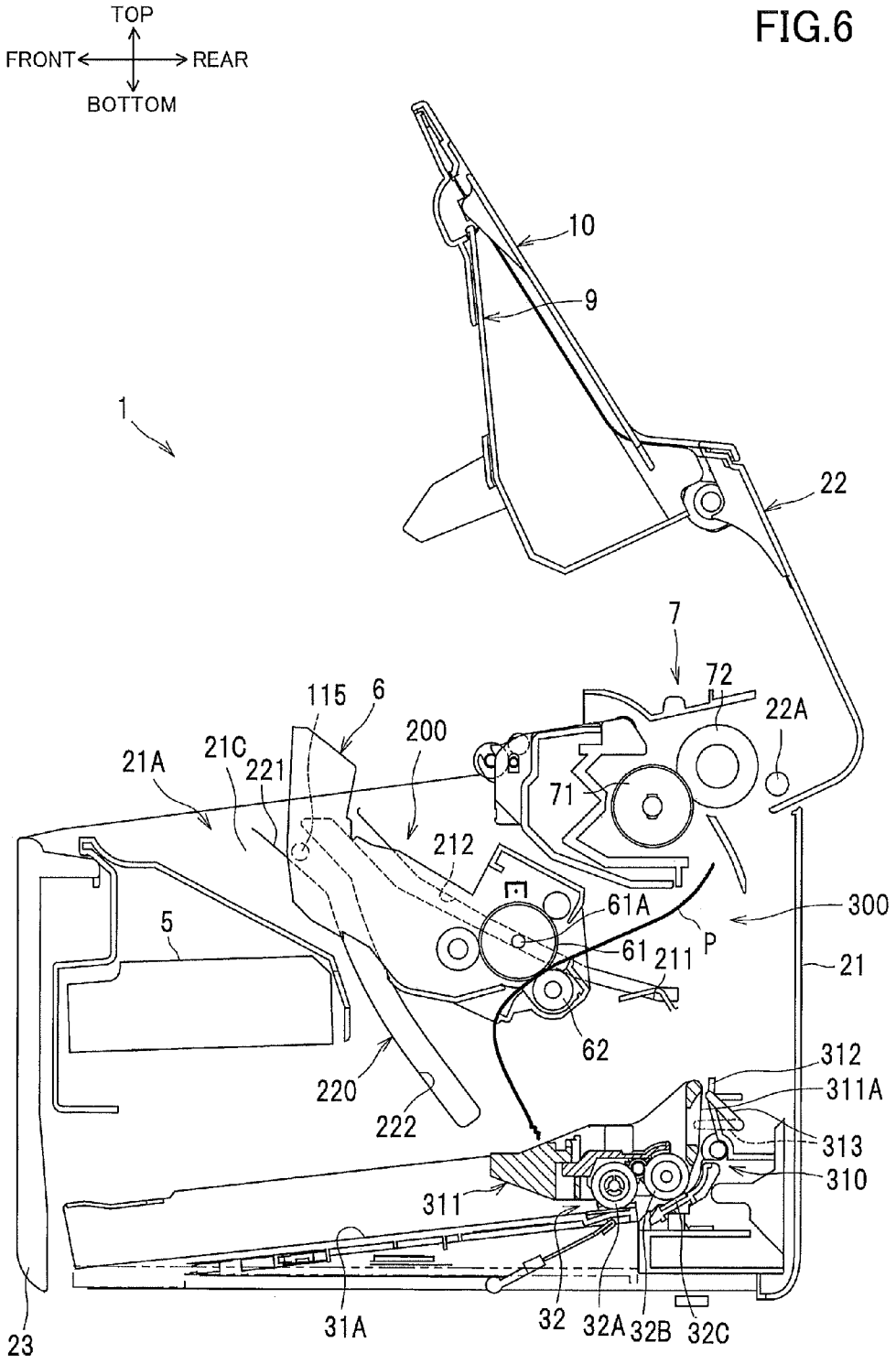
FIG. 6 is a view for description of movement of the process cartridge guided by a guide portion of a first guide and an upper portion of a second guide in the printer according to the embodiment.

In a state where the sheet P is further pulled toward the opening 21A while being nipped between the photosensitive drum 61 and the transfer roller 62, as shown in FIG. 6, the boss 115 guided by the lower portion 222 is further moved upward, so that the process cartridge 6 has a posture such that the front end portion is positioned higher than the rear end portion. As shown in FIG. 6, the transfer roller 62 confronts the photosensitive drum 61 from below, and is positioned below the first guide 210.

In this way, a sheet pulling posture of the process cartridge 6 can be defined by the shaft 61A and the boss 115 guided along the first guide 210 and the second guide 220, respectively.

Figure 7:
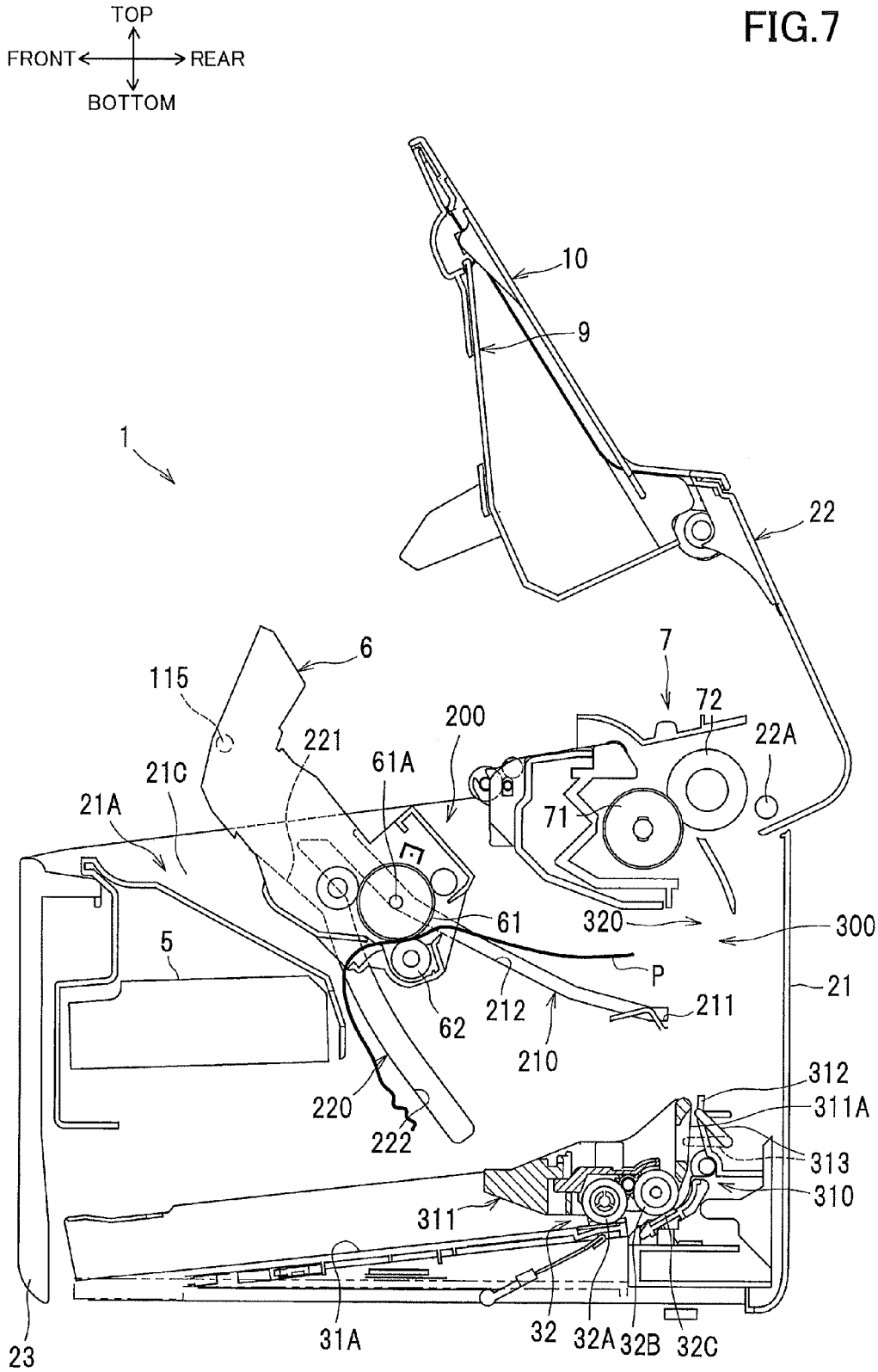
FIG. 7 is a view showing a posture of the process cartridge when the process cartridge is about to be separated from the main casing in the printer according to the embodiment.

When the process cartridge 6 having front up rear down posture is moved upward together with the movement of the shaft 61A along the guide portion 212 of the first guide 210, as shown in FIG. 7, the process cartridge 6 is detached from the main casing 21 while pulling the sheet P nipped between the photosensitive body 61 and the transfer roller 62 upward. Thus, the jammed sheet P can be firmly removed from the main casing 21 in comparison with a case where a process cartridge is moved downward and/or forward/rearward.

While the invention has been described in detail with reference to the embodiments thereof, it would be apparent to those skilled in the art that various changes and modifications may be made therein without departing from the scope and spirit of the invention.

In the above-described embodiment, the path length between the separation roller 32B (the first conveyor roller) and the sheet nip position between the heat roller 71 and the pressure roller 72 (the second conveyer roller), is shorter than the sheet length in the sheet conveying direction. However, the present invention is not limited to this path length. For example, a first conveyor roller can be positioned between the separation roller 32B and the transfer roller 62, and a second conveyor roller can be positioned between the fixing unit 7 and the transfer roller 62. In this case, the path length between the separation roller 32B and the sheet nip position between the heat roller 71 and the pressure roller 72 may be longer than the sheet length in the sheet conveyer direction, as long as a path length between the first conveyor roller and the second conveyor roller is provided to be shorter than the sheet length in the sheet conveying direction.

In the above-described embodiment, the sheet passage 300 extends in the vertical direction. However, the present invention is not limited to this sheet passage 300. For example, the sheet passage 300 may extend in a horizontal direction. In the latter case, the first guide 210 including the support portion 211 and the guide portion 212 can be formed to extend in a vertical direction.

In the above-described embodiment, the process cartridge 6 is attachable to and detachable from the main casing 21 through the opening 21A, which is open upward. However, the process cartridge 6 may be attachable to and detachable from the main casing 21 through an opening formed at the side panel of the main casing 21. In the latter case, the downstream portion of the first guide 210 in the detaching direction of the process cartridge 6 can be formed to extend in a horizontal direction.

In the above described embodiment, the spring S is employed as an urging member. However, a leaf spring or a compression spring is also available as the urging member.

In the above described embodiment, the photosensitive drum 61 is employed as a photosensitive body. However, a photosensitive belt is also available as the photosensitive body.

In the above described embodiment, the sheets P may include thick paper, postcards, thin paper, and transparencies.

What is claimed is:

1. An image forming device for forming an image on a sheet, the image forming device comprising:

a main casing having an opening;

a process cartridge comprising a photosensitive drum, a transfer roller facing the photosensitive drum, and a protrusion protruding from the process cartridge, the photosensitive drum having a drum shaft, the drum shaft protruding from the process cartridge at a position away from the protrusion, the process cartridge being configured to be attachable to and detachable from the main casing through the opening of the main casing;

a sheet passage including a portion through which the sheet passes between the photosensitive drum and the transfer roller, the portion extending in a first direction; and a first guide having a downstream end portion in a detaching direction of the process cartridge, the downstream end portion extending toward the opening of the main casing, the first guide being configured to guide the drum shaft protruding from the process cartridge such that the process cartridge is attachable to and detachable from the main casing, the first guide having a support portion, the support portion having a support surface extending in a second direction substantially perpendicular to the first direction in which the portion of the sheet passage extends, the support surface of the support portion being configured to support the drum shaft protruding from the process cartridge in an image forming position where the process cartridge performs an image forming operation, wherein, when the support surface supports the drum shaft protruding from the process cartridge, the photosensitive drum faces the transfer roller in the second direction, and wherein, when the process cartridge is being detached from the main casing, the process cartridge moves from the image forming position such that the drum shaft slides on a first side of the support surface in the second direction while the transfer roller of the process cartridge moves in the first direction to a second side of the support surface, the support surface facing away from the second side.

2. The image forming device according to claim 1, further comprising:

a first conveyer roller positioned upstream of the transfer roller in a sheet conveying direction for conveying the sheet; and a second conveyer roller positioned downstream of the transfer roller in the sheet conveying direction for conveying the sheet, the first conveyer roller and the second conveyer roller defining a sheet path length therebetween, the sheet path length being shorter than a length of the sheet in the sheet conveying direction.

3. The image forming device according to claim 1, further comprising an urging member configured to urge the transfer roller toward the photosensitive drum in a direction substantially parallel to the second direction in a state where the process cartridge is in the image forming position.

4. The image forming device according to claim 1, further comprising:

a sensor positioned downward of the process cartridge in a state where the process cartridge is in the image forming position, the sensor being configured to detect the sheet in the sheet passage; and a support member positioned between the process cartridge and the sensor to provide the sheet passage.

5. The image forming device according to claim 1, further comprising a second guide configured to guide the protrusion of the process cartridge in the state where the drum shaft protruding from the process cartridge is guided by the first guide, the second guide having a first portion and a second portion, the first portion extending toward the opening of the main casing, the second portion being curved away from the first guide such that, when the process cartridge is in the image forming position, the protrusion is disposed below the drum shaft.

6. The image forming device according to claim 1, wherein the transfer roller is configured to move across the sheet passage during attachment and detachment of the process cartridge to and from the main casing.

7. An image forming device for forming an image on a sheet, the image forming device comprising:

a main casing having an opening that opens upward;

a process cartridge comprising a photosensitive drum, a transfer roller facing the photosensitive drum, and a protrusion protruding from the process cartridge, the photosensitive drum having a drum shaft, the drum shaft protruding from the process cartridge at a position away from the protrusion, the process cartridge being configured to be attachable to and detachable from the main casing through the opening of the main casing;

a first conveyer roller positioned below the transfer roller and upstream of the transfer roller in a sheet conveying direction for conveying the sheet in a state where the process cartridge is in an image forming position where the process cartridge performs an image forming operation;

a second conveyer roller positioned above the transfer roller and downstream of the transfer roller in the sheet conveying direction for conveying the sheet in the state where the process cartridge is in the image forming position;

a sheet passage extending between the first conveyer roller and the second conveyer roller in a first direction substantially parallel to a vertical direction, the sheet passage having a portion through which the sheet passes between the photosensitive drum and the transfer roller facing the photosensitive drum in a second direction substantially perpendicular to the first direction in which the sheet passage extends; and a first guide having a downstream end portion in a detaching direction of the process cartridge, the downstream end portion extending upward toward the opening of the main casing, the first guide being configured to guide the drum shaft protruding from the process cartridge such that the process cartridge is attachable to and detachable from the main casing, the first guide having a support portion, the support portion having a support surface extending in a second direction substantially perpendicular to the sheet passage, the support surface being configured to support the drum shaft protruding from the process cartridge in the image forming position, wherein, when the support surface supports the drum shaft protruding from the process cartridge, the photosensitive drum faces the transfer roller in the second direction, and wherein, when the process cartridge is being detached from the main casing, the process cartridge moves from the image forming position such that the drum shaft slides on the support surface in the second direction while the transfer roller of the process cartridge moves downward to pass below the support surface of the first guide.

8. The image forming device according to claim 7, wherein the transfer roller is configured to move across the sheet passage during attachment and detachment of the process cartridge to and from the main casing.

9. The image forming device according to claim 7, further comprising a second guide configured to guide the protrusion protruding from the process cartridge in a state where the drum shaft protruding from the process cartridge is guided by the first guide wherein the second guide has an upper portion and a lower portion, the upper portion extending upward toward the opening of the main casing, the lower portion being curved away from the first guide such that, when the process cartridge is in the image forming position, the protrusion is disposed below the drum shaft.

10. An image forming device for forming an image on a sheet, the image forming device comprising:

a main casing having an opening that opens upward;

a process cartridge comprising a photosensitive drum, a transfer roller facing the photosensitive drum, and a protrusion protruding from the process cartridge, the photosensitive drum having a drum shaft, the drum shaft protruding from the process cartridge at a position away from the protrusion, the process cartridge being configured to be attachable to and detachable from the main casing through the opening of the main casing;

a first conveyer roller positioned below the transfer roller and upstream of the transfer roller in a sheet conveying direction for conveying the sheet in a state where the process cartridge is in the image forming position;

a second conveyer roller positioned above the transfer roller and downstream of the transfer roller in the sheet conveying direction for conveying the sheet in the state where the process cartridge is in an image forming position where the process cartridge performs an image forming operation;

a sheet passage extending between the first conveyer roller and the second conveyer roller in a first direction substantially parallel to a vertical direction, the sheet passage having a portion through which the sheet passes between the photosensitive drum and the transfer roller facing the photosensitive drum in a second direction substantially perpendicular to the first direction in which the sheet passage extends;

a first guide having a downstream end portion in a detaching direction of the process cartridge, the downstream end portion extending upward toward the opening of the main casing, the first guide being configured to guide the drum shaft protruding from the process cartridge such that the process cartridge is attachable to and detachable from the main casing, the first guide having a support portion, the support portion having a support surface extending in a second direction substantially perpendicular to the sheet passage, the support surface being configured to support the drum shaft protruding from the process cartridge in the image forming position, wherein, when the support surface supports the drum shaft protruding from the process cartridge, the photosensitive drum faces the transfer roller in the second direction, and wherein, when the process cartridge is being detached from the main casing, the process cartridge moves from the image forming position such that the drum shaft slides on the support surface in the second direction while the transfer roller of the process cartridge moves downward to pass below the support surface of the first guide; and a second guide configured to guide the protrusion protruding from the process cartridge in a state where the drum shaft protruding from the process cartridge is guided by the first guide, the second guide having an upper portion and a lower portion, the upper portion extending upward toward the opening of the main casing, the lower portion being curved away from the first guide such that, when the process cartridge is in the image forming position, the protrusion is disposed below the drum shaft.

11. The image forming device according to claim 10, further comprising an urging member configured to urge the transfer roller toward the photosensitive drum in a direction substantially parallel to the second direction in a state where the process cartridge is in the image forming position.

12. The image forming device according to claim 10, further comprising:

a sensor positioned downward of the process cartridge in a state where the process cartridge is in the image forming position, the sensor being configured to detect the sheet in the sheet passage; and a support member positioned between the process cartridge and the sensor to provide the sheet passage.

13. The image forming device according to claim 10, wherein the transfer roller is configured to move across the sheet passage during attachment and detachment of the process cartridge to and from the main casing.

* * * * *